United States Patent [19]

Newswanger

[11] 4,183,347

[45] Jan. 15, 1980

[54] AIR HEATING AND CIRCULATING FIREPLACE GRATE

[76] Inventor: Paul S. Newswanger, 1401 Vermont Ave., Lancaster, Pa. 17603

[21] Appl. No.: 833,828

[22] Filed: Sep. 16, 1977

[51] Int. Cl.[2] ..... F24B 7/04

[52] U.S. Cl. ..... 126/121; 126/164; 237/51

[58] Field of Search ..... 237/51; 126/120, 121, 126/131, 164, 165, 336, 207

[56] References Cited

U.S. PATENT DOCUMENTS

| | | | |
|---|---|---|---|
| 301,264 | 7/1884 | Pearson | 126/131 |
| 3,240,206 | 3/1966 | Schutt | 126/121 |
| 3,905,351 | 9/1975 | Hatfield | 126/121 |
| 3,938,496 | 2/1976 | Kampf | 126/121 |
| 4,008,704 | 2/1977 | Petrie | 126/131 |
| 4,077,388 | 3/1978 | Whiteley | 126/121 |

*Primary Examiner*—John J. Camby
*Assistant Examiner*—Larry I. Schwartz
*Attorney, Agent, or Firm*—Brady, O'Boyle & Gates

[57] ABSTRACT

A very low elevation, compact and unitized grate for fireplaces has a perimeter base frame to rest on the fireplace floor. The base frame is tubular and forms an inlet for cold air at the front of the fireplace substantially at floor level. The inlet air may be forced or natural draft induced. Plural nearly level forwardly diverging tubular grate bars have their rear ends connected in communication with the rear transverse section of the tubular base frame and serve the dual purpose of supporting fireplace logs and delivering heated air into the room at the front of the fireplace only slightly above floor level. The forward ends of the tubular grate bars are supported on a crossbar attached to the side members of the base frame. A minimum amount of metal is required in a very sturdy grate structure.

10 Claims, 10 Drawing Figures

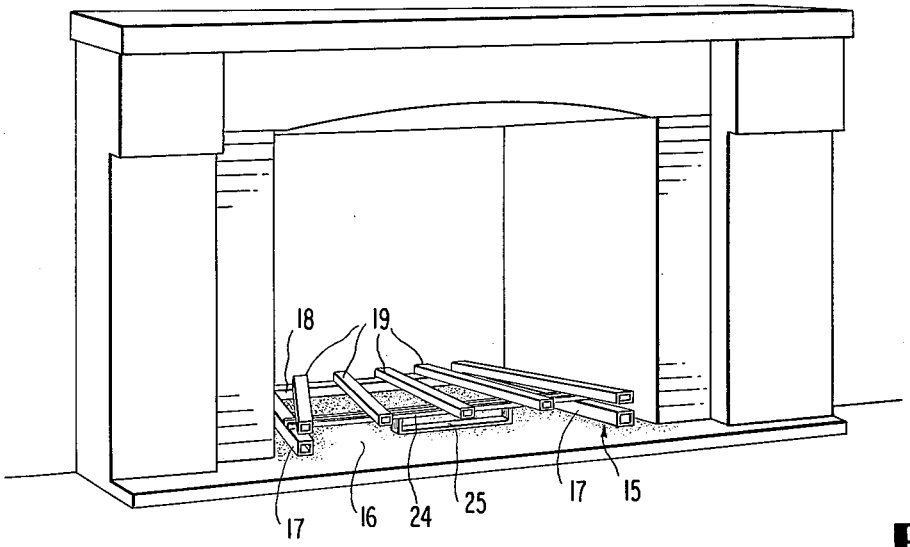
FIG. 1
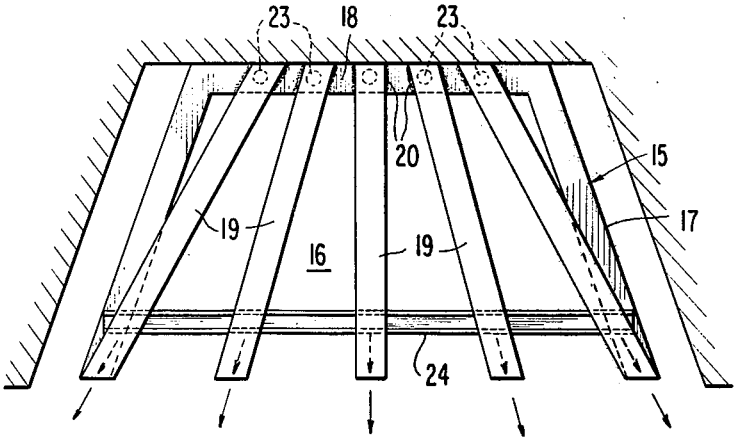
FIG. 2
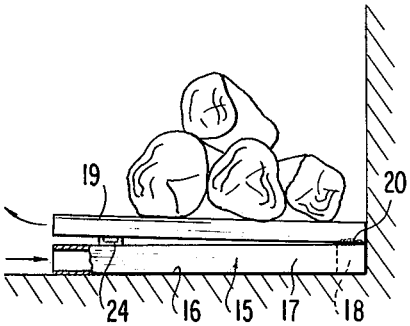
FIG. 3
FIG. 4
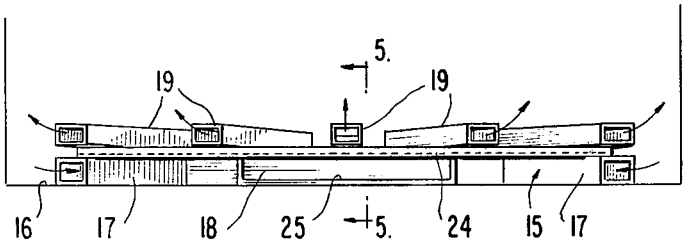
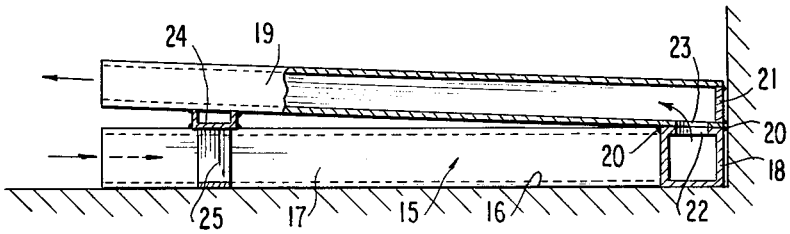
FIG. 5

FIG. 6
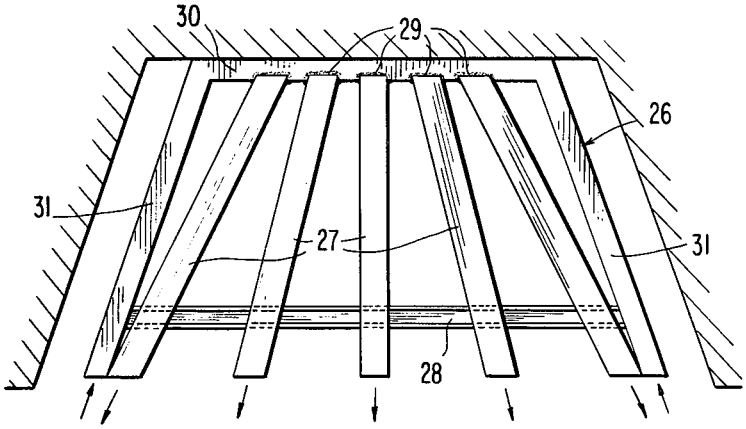
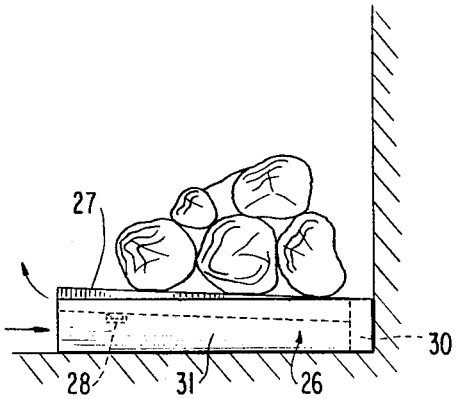
FIG. 7
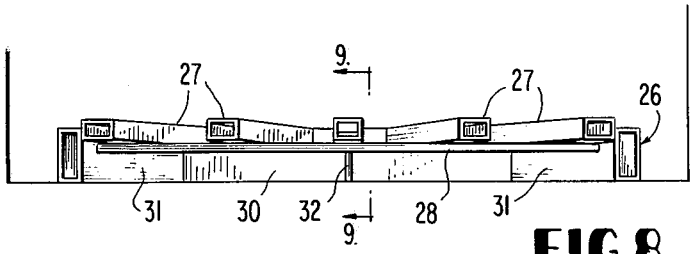
FIG. 8
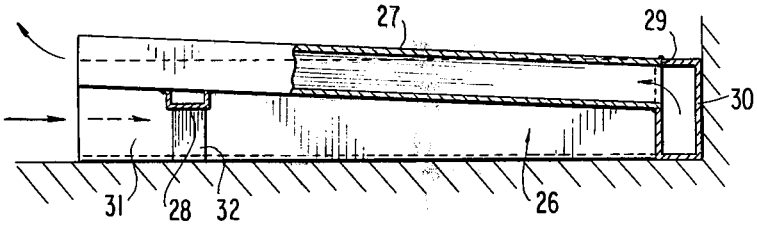
FIG. 9
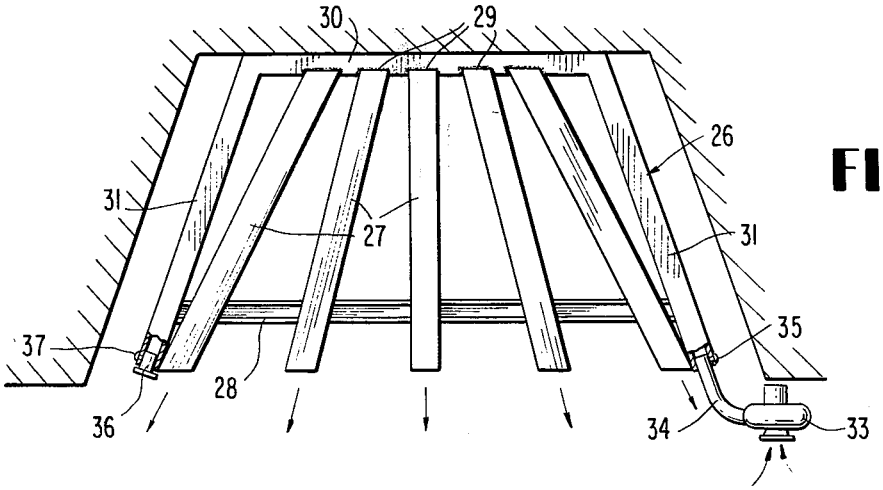
FIG. 10

AIR HEATING AND CIRCULATING FIREPLACE GRATE

BACKGROUND OF THE INVENTION

The current energy crisis has created a demand for a more efficient home fireplace to increase the practical value thereof for home heating while simultaneously reducing heating costs and the consumption of scarce fossil fuels. To satisfy this demand, recent efforts have been made to provide fireplace grates which have the ability to circulate heated air from the fireplace into the room. Some examples of patented devices for this purpose are contained in the following United States patents:

U.S. Pat. No. 3,635,211
U.S. Pat. No. 3,901,212
U.S. Pat. No. 3,905,351
U.S. Pat. No. 3,942,509.

The prime objective of this invention is to improve on the known prior art in the provision of an air heating and circulating grate for fireplaces which is more economical to construct, requiring less metal; has the ability to deliver heated air from the fireplace into a room at the lowest possible level immediately above the floor; does not restrict the flue area of the fireplace or obstruct radiant heating from the brick back wall of the fireplace; and which contains no vertical bars or tubes to restrict the front-to-back depth of the fireplace.

The known prior art is deficient in one or all of the above specified ideal features for an air heating and circulating fireplace grate.

Another object of the invention is to produce a grate of the above class which has a rigid unit construction with the members thereof secured in assembled relationship by welding.

Other features and advantages of the invention will become apparent during the course of the following description.

BRIEF DESCRIPTION OF THE DRAWINGS

FIG. 1 is a front perspective view of an air heating and circulating fireplace grate according to a first embodiment of the invention.

FIG. 2 is a plan view of the grate.

FIG. 3 is a side elevation thereof, partly in section.

FIG. 4 is a front elevational view of the grate.

FIG. 5 is a vertical section taken on line 5—5 of FIG. 4, partly broken away.

FIG. 6 is a plan view of a grate according to a second embodiment of the invention.

FIG. 7 is a side elevation thereof.

FIG. 8 is a front elevation of the grate.

FIG. 9 is a vertical section taken on line 9—9 of FIG. 8.

FIG. 10 is a plan view showing a variant of the invention applicable to either embodiment enabling the grate to receive air from a blower whereby heated air can be forced from the fireplace into a room.

DETAILED DESCRIPTION

Referring to the drawings in detail, and first considering FIGS. 1 through 5, wherein like numerals designate like parts, a metal fireplace grate comprises a base frame 15 which is horizontally disposed during use and rests directly on the floor 16 of a fireplace, as illustrated. The base frame is approximately U-shaped, tubular and of rectangular cross section. It has forwardly diverging sides 17 which are preferably parallel to the fireplace side walls and a rear transverse section 18 which spans the rear wall of the fireplace preferably in abutment therewith during use, as shown. The base frame 15 is of unit construction. Its width and depth dimensions can be varied to accommodate different sizes of fireplaces and dimensions are not critical in the invention. The tubing of the base frame 15 may be square tubing measuring two inches on each side, and this again is not critical and can be varied in some cases. In fact, tubing of another cross section, such as round tubing, could be employed in the invention, if desired.

The grate additionally comprises a plurality of front-to-back slightly inclined and forwardly divergent tubular grate bars 19 which are also rectangular in cross section. Preferred cross sectional dimensions for the grate bars 19 are two inches horizontally by one and one-half inches vertically, and again, these dimensions are not critical and may be varied. By employing rectangular tubing in the size indicated, the vertical height of the grate can be limited to approximately four inches at the front of the grate and this very low delivery level for heated air flowing into the room is one of the major features of the invention. The grate bars 19 are preferably five in number, as shown, but a lesser or greater number may be employed in some instances.

The rear end portions of the bars 19 rest on the rear cross section 18 of base frame 15 and are welded thereto as at 20 in FIGS. 2, 3 and 5 to seal the bars against entry by fumes. The rear ends of the bars 19, except for the center bar, are cut on the bias to be flush with the rear side of the base frame and the rear fireplace wall. The rear ends of the bars 19 are closed by plugging plates 21. The top of the base frame rear section 18 has spaced openings 22 which are in registration with like openings 23 in the bottoms of grate bars 19 near their rear ends so that air drawn or forced into the front of the tubular base frame 15 will be delivered through the openings 22 and 23 into the rear ends of the bars 19 and then forwardly through such tubular bars into the room at the front of the fireplace. The air circulation path is shown by arrows in the drawings. The forward divergent or spread relationship of the tubular bars 19 directs heated air from the fireplace into the room rear floor level over the widest possible horizontal expanse in the room.

Near their forward ends, the bars 19 are supported on a transverse support bar or brace 24 which has its opposite end portions welded to the tops of base frame sides 17. The bars 19 are also welded to the brace 24, as shown. The arrangement provides a slight upward inclination in the forward direction to the grate bars 19 tending to prevent logs from moving forwardly on the grate. Even with this inclination, the front of the grate need not exceed four inches in height, as previously stated. The arrangement is not only very shallow but also highly compact and sturdy and only an absolute minimum of material is utilized in the grate. This contributes to economy of manufacture.

An optional removable U-shaped center support leg 25 for the bottom crossbrace 24 is shown in the drawings and the base portion of this support leg rests on the fireplace floor and the tops of the upstanding portions frictionally engage the bottom of brace 24 to counteract possible deformation of the brace 24 over a long period of time. This support leg member stands between brace 24 and the floor and is easily removed and replaced for removing ashes from beneath the grate.

FIGS. 6 to 9 show a second embodiment of the invention in which a base frame 26 similar to the base frame 15 is employed in conjunction with back-to-front divergent tubular grate bars 27 and a forward transverse brace 28. The overall construction is very similar to the prior embodiment but differs therefrom in several important respects as follows.

Instead of being square in cross section, the tubular base frame 26 is rectangular and has a preferred height dimension of about three and one-half inches and a width of one and one-half inches. Unlike the first embodiment, the rear ends of the rectangular tubular grate bars 27 remain open and are received within notches 29 formed in the forward side of the rear transverse section 30 of base frame 26. The rear ends of the bars 27 are welded all around in the notches 29 so that the interiors of the bars 27 are in open communications with the tubular member or section 30, FIG. 9, and no fumes from the fire or coals can enter the bars.

The forward transverse brace 28 has its opposite ends welded to the side walls and not to the tops of side members 31 of base frame 26. Hence, the tubular bars 27 are not bodily above the base frame as in the prior embodiment but are disposed inwardly of the side members 31, FIG. 9, with only forward portions of the bars 27 projecting above the members 31. An optional center support leg 32 welded to the brace bar 28 is shown in the drawings but this leg may be omitted or replaced by the removable support leg 25 of FIGS. 1–5, or vice versa. The modified construction possesses the same mode of operation and has basically the same features and advantages over the prior art specified above relative to the prior embodiment of the invention.

FIG. 10 shows a feature of the invention which is illustrated in connection with the second embodiment of FIGS. 6 to 9, but is equally applicable to the first embodiment. In FIG. 10, an electric blower 33 at the front and one side of the fireplace has a delivery conduit 34 which is telescopically engaged in the forward end of the member 31 and secured therein by a set screw 35. The opposite side or member 31 has a removable plug 36 and set screw 37, whereby users of the invention have a choice at all times as to which side of the base frame 26 can be coupled to the blower 33 and which side of the fireplace the blower can be installed on for the convenience of the user.

In any case, the arrangement in FIG. 10 allows heated air to be forced from the front of the tubular bars 27 and into the room, instead of relying on a natural draft or convection air flow.

Because of the low profile construction of the grate, heated air is delivered by the log supporting tubes for a substantially longer period of time than prior known air circulating fireplace grates, since both the base frame 15, 31 and the bars 19,27 are disposed in contact with the hot coals from a fire which continue to heat and circulate the air in these hollow members long after the fire has been refueled. The open front U-shaped construction of the base frame 15, 31 and the manner in which the log supporting tubes are supported thereon provides a relatively unobstructed front clean-out opening under the log supporting tubes to enable ashes to be removed from beneath the grate without having to remove it from the fireplace.

It is to be understood that bars 19, 27 can be connected substantially parallel with the fireplace floor and the plane of the base frame and not inclined relative thereto as shown, if desired. For such a construction, the ends of the support bars 24, 28 are connected to the sides of the base frame sides 17, 31 at a lower level, or the ends of the support bars are deformed at their connection to the base frame sides to position the support bars 24, 28 at a lower level. With this construction, the bars 27 in the arrangement of FIGS. 6 to 10 are within the plane of the base frame 26.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An air heating and circulating fireplace grate comprising a tubular base frame adapted to rest on a fireplace floor and including a transversely extending rear section and side sections connected thereto in fluid communication and extending forwardly therefrom, and adapted to be respectively arranged adjacent to the rear and side walls of a fireplace and to be in contact with coals from a fire while in use, said rear sections and side sections having lower surfaces adapted for placement immediately adjacent a fireplace floor substantially throughout the lengths thereof, at least one side section of the tubular base frame being forwardly open, a plurality of front-to-back tubular grate bars having rear end portions secured to said rear section with the interiors of the grate bars and rear section in fluid communication, a raised support member for the tubular grate bars near their forward ends and being secured to said side sections of the tubular base frame at a distance above the lower surfaces thereof, said raised support member supporting the tubular grate bars in an upward inclination forwardly and defining a front ash removal opening for the space beneath said tubular grate bars and bounded by said tubular base frame, and the forward ends of the tubular grate bars being open for delivering heated air to a room from a fireplace in which the grate is being utilized.

2. An air heating and circulating fireplace grate as defined in claim 1, wherein said grate bars diverge forwardly from said rear section of the tubular base frame and have their forward ends widely spaced to span a major portion of the open front of a fireplace.

3. An air heating and circulating fireplace grate as defined in claim 2, and the forward ends of the grate bars being substantially in transverse alignment with each other and with the forward ends of said side section of the base frame.

4. An air heating and circulating fireplace grate as defined in claim 1, and the tubular base frame and said tubular grate bars formed of rectangular cross section tubing.

5. An air heating and circulating fireplace grate as defined in claim 1, and the rear end portions of said grate bars resting on top of said rear section of the base frame and having bottom wall openings arranged in registration with top wall openings of said rear section of the base frame, the rear ends of the tubular grate bars being closed rearwardly of said registering openings.

6. An air heating and circulating fireplace grate as defined in claim 1, and said rear section of the base frame having spaced notches in its forward side, the rear ends of the grate bars being secured in said notches with their interiors in communication with the interior of said rear section, the rear ends of the grate bars being open.

7. An air heating and circulating fireplace grate as defined in claim 1, and a closure plug for the forward open end of one side section of the tubular base frame and being removable and insertable selectively in the forward open end of the other side section of the base frame, whereby a blower conduit coupled selectively with the forward open end of either side section of the base frame while the corresponding open end of the other side section is plugged.

8. An air heating and circulating fireplace grate as defined in claim 7, and a set screw on each side of the base frame near its forward open end to releasably secure said plug or said blower conduit in coupled relation with one side section of the base frame.

9. An air heating and circulating fireplace grate comprising a tubular base frame adapted to rest on a fireplace floor and including a transversely extending rear section and side sections connected thereto in fluid communication and extending forwardly therefrom, and adapted to be respectively arranged adjacent to the rear and side walls of a fireplace, at least one side section of the tubular base frame being forwardly open, a plurality of front-to-back tubular grate bars having rear end portions secured to said rear section with the interiors of the grate bars and rear section in fluid communication, a raised support member for the tubular grate bars near their forward ends, secured on top of said side sections of said base frame and engaging the bottoms of the grate bars and being secured thereto and supporting the grate bars at an upward inclination forwardly relative to said base frame, the base frame being substantially level during the use of said grate, said raised support member defining a front ash removal opening for the space beneath said tubular grate bars and bounded by said tubular base frame, and the forward ends of the tubular grate bars being open for delivering heated air to a room from a fireplace in which the grate is being utilized.

10. An air heating and circulating fireplace grate comprising a tubular base frame adapted to rest on a fireplace floor and including a transversely extending rear section and side sections connected thereto in fluid communication and extending forwardly therefrom, and adapted to be respectively arranged adjacent to the rear and side walls of a fireplace at least one side section of the tubular base frame being forwardly open, said rear section having spaced notches in its forward side, a plurality of front-to-back tubular grate bars having open rear end portions secured in said notches with their interiors in fluid communication with the interior of said rear section, a raised support member for the tubular grate bars near their forward ends and having its ends secured to the interior side walls of said side sections of the tubular base frame and underlying the tubular grate bars and being secured thereto and supporting the grate bars at an upward inclination forwardly, said raised support member defining a front ash removal opening for the space beneath said tubular grate bars and bounded by said tubular base frame, the forward end portions of the grate bars projecting somewhat above the level of the base frame and their rear ends disposed within the confines of the base frame, and the forward ends of the tubular grate bars being open for delivering heated air to a room from a fireplace in which the grate is being utilized.

* * * * *